US011348750B2

(12) United States Patent
Kawaguchi et al.

(10) Patent No.: US 11,348,750 B2
(45) Date of Patent: May 31, 2022

(54) RELAY

(71) Applicant: OMRON Corporation, Kyoto (JP)

(72) Inventors: Naoki Kawaguchi, Yame (JP); Ryota Minowa, Yamaga (JP); Yasuo Hayashida, Kumamoto (JP); Kohei Otsuka, Omuta (JP); Shingo Mori, Yamaga (JP); Hiroyuki Iwasaka, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/262,209

(22) PCT Filed: Feb. 19, 2019

(86) PCT No.: PCT/JP2019/006168
§ 371 (c)(1),
(2) Date: Jan. 22, 2021

(87) PCT Pub. No.: WO2020/031403
PCT Pub. Date: Feb. 13, 2020

(65) Prior Publication Data

US 2021/0335565 A1 Oct. 28, 2021

(30) Foreign Application Priority Data

Aug. 10, 2018 (JP) ..... JP2018-151595

(51) Int. Cl.
*H01H 50/38* (2006.01)
*H01H 50/60* (2006.01)
*H01H 9/44* (2006.01)

(52) U.S. Cl.
CPC ..... *H01H 50/38* (2013.01); *H01H 9/443* (2013.01); *H01H 50/60* (2013.01)

(58) Field of Classification Search
CPC ..... H01H 50/38; H01H 50/54; H01H 50/60; H01H 9/443
See application file for complete search history.

(56) References Cited

U.S. PATENT DOCUMENTS 6,700,466 B1 * 3/2004 Yamamoto ..... H01H 9/443 335/132
8,653,691 B2 * 2/2014 Hsu ..... H01H 50/36 307/10.1

(Continued)

FOREIGN PATENT DOCUMENTS

JP 60-193647 U 12/1985
JP 4-51373 Y2 12/1992

(Continued)

OTHER PUBLICATIONS

The International Search Report of International Application No. PCT/JP2019/006168 dated May 7, 2019.

(Continued)

*Primary Examiner* — Bernard Rojas
(74) *Attorney, Agent, or Firm* — Shinjyu Global IP

(57) ABSTRACT

A relay includes a first fixed contact, a second fixed contact, a movable contact piece having first and second movable contacts, a contact piece holding unit configured to hold the movable contact piece, and first to fourth magnets. The first magnet and the second magnet are disposed so that same poles thereof face each other. The movable contact piece is disposed between the first magnet and the second magnet in a width direction of the movable contact piece. The third magnet is disposed so as to increase a magnetic flux in a longitudinal direction of the movable contact piece at a position between the first fixed contact and the first movable contact. The fourth magnet is disposed so as to increase a magnetic flux in the longitudinal direction of the movable (Continued)

contact piece at a position between the second fixed contact and the second movable contact.

19 Claims, 8 Drawing Sheets

(56) References Cited

U.S. PATENT DOCUMENTS

| | | | | |
|---|---|---|---|---|
| 9,117,605 | B2 * | 8/2015 | An | H01H 50/163 |
| 9,373,467 | B2 * | 6/2016 | Naka | H01H 9/443 |
| 2015/0380193 | A1 | 12/2015 | Kashimura et al. | |

FOREIGN PATENT DOCUMENTS

| | | | |
|---|---|---|---|
| JP | 2003-197053 | A | 7/2003 |
| JP | 2011-204480 | A | 10/2011 |
| WO | 2015/001710 | A1 | 1/2015 |

OTHER PUBLICATIONS

The Written Opinion of International Searching Authority of International Application No. PCT/JP2019/006168 dated May 7, 2019.

* cited by examiner

RELAY

CROSS-REFERENCE TO RELATED APPLICATION

This application is the U.S. National Phase of International Application No. PCT/JP2019/006168, filed on Feb. 19, 2019. This application claims priority to Japanese Patent Application No. 2018-151595, filed Aug. 10, 2018. The contents of that application are incorporated by reference herein in their entireties.

FIELD

The present invention relates to a relay.

BACKGROUND

Some relays include a magnet in order to extinguish an arc generated at contacts (see Japanese Laid-Open Patent Publication No. 2011-204480). For example, two permanent magnets are disposed facing each other, and a movable contact piece is disposed between the two permanent magnets. When an arc is generated between the contacts, Lorentz force acts on the arc by magnetic force of the permanent magnets. As a result, the arc is extended and quickly extinguished.

For example, in FIG. 8A, two magnets 100 and 101 are disposed facing each other in a width direction of a movable contact piece (in the up-down direction in FIGS. 8A and 8B), and the magnets 100 and 101 are disposed so that the opposite poles thereof face each other. In this case, a magnetic flux is generated in a direction from the magnet 100 toward the magnet 101. In this case, an extending direction of the arc changes inward or outward in a longitudinal direction of a movable contact piece 102 (in the left-right direction in FIGS. 8A and 8B) according to a current flow direction at the contacts. For example, when a current flows in a certain direction in the movable contact piece 102, Lorentz force acts outward from the movable contact piece 102 as indicated by arrows F100 and F101. When a current flows in the opposite direction, Lorentz force acts inward toward the movable contact piece 102 as indicated by arrows F102 and F103. This causes a difference in arc extinguishing properties according to the current flow direction at the contacts.

SUMMARY

On the other hand, in FIG. 8B, two permanent magnets 200 and 201 are disposed facing each other in the longitudinal direction of a movable contact piece 202, and the magnets 200 and 201 are disposed so that the opposite poles thereof face each other. In this case, as illustrated in FIG. 8B, a magnetic flux is generated at the contacts along the longitudinal direction of the movable contact piece 202. Therefore, an extending direction of an arc is the width direction of the movable contact piece 102. For example, when a current flows in a certain direction in the movable contact piece 202, Lorentz force acts in the width direction of the movable contact piece 102 as indicated by arrows F200 and F201. When a current flows in the opposite direction, Lorentz force acts in the width direction of the movable contact piece 102 as indicated by arrows F202 and F203. In this case, the current flow direction has less influence on the arc extinguishing properties.

In the relay, however, the movable contact piece is held by a contact piece holding unit. The contact piece holding unit includes, for example, a drive shaft connected to the movable contact piece. The contact piece holding unit is driven by a driving device to move the movable contact piece. Therefore, wear debris may be generated due to wear between the movable contact piece and the contact piece holding unit or between the components of the contact piece holding unit.

In the disposition of the magnets as illustrated in FIG. 8B, if the wear debris generated in the contact piece holding unit is attracted to the magnets, the wear debris moves toward the contacts. Therefore, the wear debris may be caught between the contacts. In this case, the contact resistance between the contacts increases, causing a deterioration in the energization performance.

An object of the present invention is to reduce the deterioration in the energization performance due to wear debris while reducing an influence on the arc extinguishing properties by the current flow direction.

A relay according to one aspect includes a first fixed contact, a second fixed contact, a movable contact piece, a contact piece holding unit, a first magnet, a second magnet, a third magnet, and a fourth magnet. The movable contact piece includes a first movable contact and a second movable contact that are disposed apart from each other in a longitudinal direction. The movable contact piece is movably disposed in a direction in which the first movable contact and the second movable contact come into contact with the first fixed contact and the second fixed contact and in a direction in which the first movable contact and the second movable contact separate from the first fixed contact and the second fixed contact. The contact piece holding unit holds the movable contact piece at a position between the first movable contact and the second movable contact in the longitudinal direction of the movable contact piece.

The first magnet is disposed at one side of the movable contact piece in a width direction of the movable contact piece that intersects the longitudinal direction of the movable contact piece. The second magnet is disposed at the other side of the movable contact piece in the width direction of the movable contact piece. The third magnet is disposed apart from the first fixed contact and the first movable contact in a moving direction of the movable contact piece. The fourth magnet is disposed apart from the second fixed contact and the second movable contact in the moving direction of the movable contact piece.

The first magnet and the second magnet are disposed so that same poles thereof face each other. The movable contact piece is disposed between the first magnet and the second magnet in the width direction of the movable contact piece. The third magnet is disposed so as to increase a magnetic flux in the longitudinal direction of the movable contact piece at a position between the first fixed contact and the first movable contact. The fourth magnet is disposed so as to increase a magnetic flux in the longitudinal direction of the movable contact piece at a position between the second fixed contact and the second movable contact.

In the relay according to the present embodiment, the first magnet and the second magnet are disposed so that the same poles thereof face each other, and the movable contact piece is disposed between the first magnet and the second magnet in the width direction of the movable contact piece. Therefore, a magnetic flux is generated at the contacts along the longitudinal direction of the movable contact piece. As a result, it is possible to reduce the influence on the arc extinguishing properties by the current flow direction.

The movable contact piece is disposed between the first magnet and the second magnet in the width direction of the movable contact piece. Therefore, even if the wear debris generated from the contact piece holding unit is attracted to the first magnet or the second magnet, the wear debris moves in a direction different from where the contacts are located. Therefore, it is possible to prevent the wear debris from being caught between the contacts and to reduce the deterioration in the energization performance due to the wear debris.

The third magnet is disposed so as to increase the magnetic flux in the longitudinal direction of the movable contact piece at a position between the first fixed contact and the first movable contact. The fourth magnet is disposed so as to increase the magnetic flux in the longitudinal direction of the movable contact piece at a position between the second fixed contact and the second movable contact. This enables to improve the arc extinguishing properties. Further, even if the wear debris generated from the contact piece holding unit is attracted to the third magnet or the fourth magnet, the wear debris moves in a direction different from the contacts are located. Therefore, it is possible to prevent the wear debris from being caught between the contacts and to reduce the deterioration in the energization performance due to the wear debris.

The relay may further include a case. The case may include a first housing portion and a second housing portion. The first housing portion may house the first fixed contact, the second fixed contact, and the movable contact piece. The second housing portion may be partitioned from the first housing portion. At least one of the third magnet or the fourth magnet may be disposed in the second housing portion. In this case, it is possible to prevent the wear debris from adhering to the third magnet and/or the fourth magnet.

The relay may further include a first partition wall disposed between the first fixed contact and the third magnet. In this case, the first partition wall can prevent the wear debris from adhering to the third magnet.

The relay may further include a second partition wall disposed between the second fixed contact and the fourth magnet. In this case, the second partition wall can prevent the wear debris from adhering to the fourth magnet.

The first fixed contact may be disposed between the first movable contact and the third magnet in the moving direction of the movable contact piece. In this case, the third magnet can be disposed so as to increase the magnetic flux in the longitudinal direction of the movable contact piece at a position between the first fixed contact and the first movable contact. Further, since the first fixed contact does not move, the third magnet can be disposed proximate to the first fixed contact.

The second fixed contact may be disposed between the second movable contact and the fourth magnet in the moving direction of the movable contact piece. In this case, the fourth magnet can be disposed so as to increase the magnetic flux in the longitudinal direction of the movable contact piece at a position between the second fixed contact and the second movable contact. Further, since the second fixed contact does not move, the fourth magnet can be disposed proximate to the second fixed contact.

The movable contact piece may be disposed between the first fixed contact and the third magnet in the moving direction of the movable contact piece. In this case, the third magnet can be disposed so as to increase the magnetic flux in the longitudinal direction of the movable contact piece at a position between the first fixed contact and the first movable contact.

The movable contact piece may be disposed between the second fixed contact and the fourth magnet in the moving direction of the movable contact piece. In this case, the fourth magnet can be disposed so as to increase the magnetic flux in the longitudinal direction of the movable contact piece at a position between the second fixed contact and the second movable contact.

When viewed from the moving direction of the movable contact piece, at least a part of the third magnet may overlap with the first fixed contact or the first movable contact. In this case, the third magnet can effectively increase the magnetic flux in the longitudinal direction of the movable contact piece at a position between the first fixed contact and the first movable contact.

When viewed from the moving direction of the movable contact piece, at least a part of the fourth magnet may overlap with the second fixed contact or the second movable contact. In this case, the fourth magnet can effectively increase the magnetic flux in the longitudinal direction of the movable contact piece at a position between the second fixed contact and the second movable contact.

A length of the first magnet in the longitudinal direction of the movable contact piece may be less than a distance between the first movable contact and the second movable contact in the longitudinal direction of the movable contact piece. In this case, even if the wear debris generated from the contact piece holding unit is attracted to the first magnet, it is possible to prevent the wear debris from approaching the first movable contact or the second movable contact. As a result, it is possible to reduce the deterioration in energization performance due to wear debris.

A length of the second magnet in the longitudinal direction of the movable contact piece may be less than a distance between the first movable contact and the second movable contact in the longitudinal direction of the movable contact piece. In this case, even if the wear debris generated from the contact piece holding unit is attracted to the second magnet, it is possible to prevent the wear debris from approaching the first movable contact or the second movable contact. As a result, it is possible to reduce the deterioration in energization performance due to wear debris.

DETAILED DESCRIPTION

Figure 1:
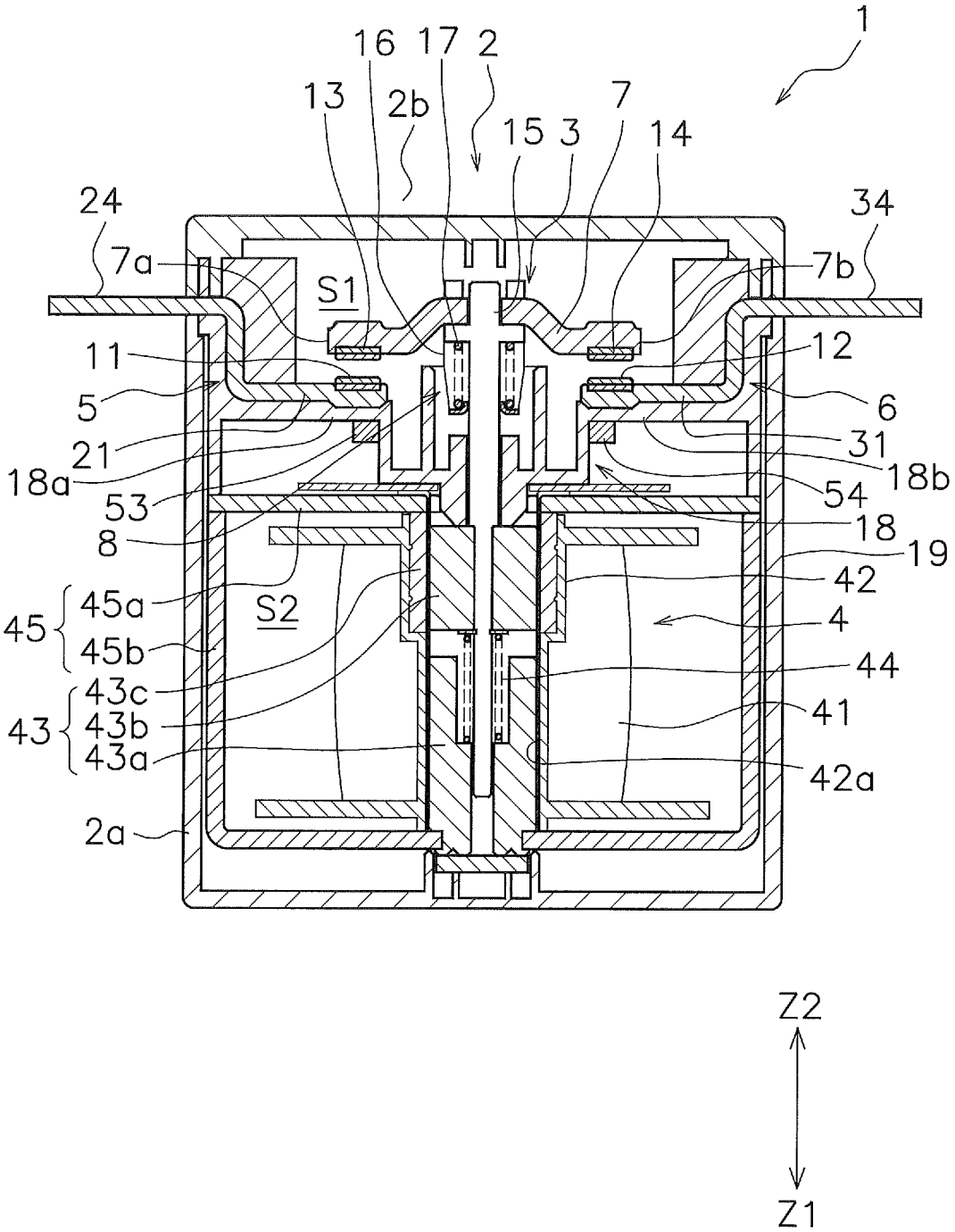
FIG. 1 is a cross-sectional view illustrating a relay according to an embodiment.

A relay 1 according to an embodiment will be described below with reference to the drawings. FIG. 1 is a side cross-sectional view illustrating the relay 1 according to the embodiment. As illustrated in FIG. 1, the relay 1 includes a case 2, a contact device 3, and a drive device 4. In the following description, the up, down, left, and right directions indicate the up, down, left, and right directions in FIG. 1. The front-back direction is a direction perpendicular to the sheet of FIG. 1. However, these definitions are not intended to limit the directions in which the relay 1 is disposed.

The case 2 houses the contact device 3 and the drive device 4. The case 2 is made from an insulating material such as resin. The case 2 includes a case body 2*a* and a cover 2*b*. The contact device 3 and the drive device 4 are disposed in the case body 2*a*. The cover 2*b* is a separate body from the case body 2*a*. The cover 2*b* is attached to the case body 2*a*. The case body 2*a* includes a contact case 18 and an outer case 19. The contact case 18 partitions the inside of the case 2 into a first housing portion S1 and a second housing portion S2. The contact device 3 is disposed in the first housing portion S1. The drive device 4 is disposed in the second housing portion S2. The outer case 19 houses the contact case 18.

The contact device 3 includes a first fixed terminal 5, a second fixed terminal 6, a movable contact piece 7, and a contact piece holding unit 8. The first fixed terminal 5, the second fixed terminal 6, and the movable contact piece 7 are made from a conductive material such as copper. The first fixed terminal 5 includes a first fixed contact 11. The second fixed terminal 6 includes a second fixed contact 12. The first fixed contact 11 and the second fixed contact 12 are disposed apart in the left-right direction.

The movable contact piece 7 extends in the left-right direction. In the present embodiment, the longitudinal direction of the movable contact piece 7 coincides with the left-right direction. The movable contact piece 7 includes a first movable contact 13 and a second movable contact 14. The first movable contact 13 and the second movable contact 14 are disposed apart in the left-right direction. The first movable contact 13 is disposed facing the first fixed contact 11. The second movable contact 14 is disposed facing the second fixed contact 12.

The movable contact piece 7 includes a first end portion 7*a* and a second end portion 7*b*. The first end portion 7*a* is one end portion of the movable contact piece 7 in the left-right direction. The second end portion 7*b* is the other end portion of the movable contact piece 7 in the left-right direction. In the present embodiment, the first end portion 7*a* is the left end portion of the movable contact piece 7. The second end portion 7*b* is the right end portion of the movable contact piece 7. The first movable contact 13 is disposed between the center of the movable contact piece 7 in the left-right direction and the first end portion 7*a*. The second movable contact 14 is disposed between the center of the movable contact piece 7 in the left-right direction and the second end portion 7*b*.

The movable contact piece 7 is disposed so as to be movable in the up-down direction. Specifically, the movable contact piece 7 is disposed so as to be movable in a contact direction Z1 and a separation direction Z2. The contact direction Z1 is a direction in which the first movable contact 13 and the second movable contact 14 contact the first fixed contact 11 and the second fixed contact 12 (downward in FIG. 1). The separation direction Z2 is a direction in which the first movable contact 13 and the second movable contact 14 separate from the first fixed contact 11 and the second fixed contact 12 (upward in FIG. 1).

The contact piece holding unit 8 holds the movable contact piece 7. The contact piece holding unit 8 holds the movable contact piece 7 at the center of the movable contact piece 7 in the left-right direction. Therefore, the contact piece holding unit 8 holds the movable contact piece 7 at a position between the first movable contact 13 and the second movable contact 14 in the left-right direction.

The contact piece holding unit 8 includes a drive shaft 15, a holder 16, and a contact spring 17. The drive shaft 15, the holder 16, and the contact spring 17 are made from metal such as stainless steel. However, the drive shaft 15, the holder 16, and the contact spring 17 may be made from metal other than stainless steel. Alternatively, a part of the contact piece holding unit 8 may be made from a material such as resin, instead of metal.

The drive shaft 15 extends in the up-down direction. The drive shaft 15 is disposed so as to be movable in the contact direction Z1 and the separation direction Z2. The holder 16 is connected to the movable contact piece 7 and holds the movable contact piece 7. The contact spring 17 is disposed between the drive shaft 15 and the holder 16. The drive shaft 15 is connected to the holder 16 via the contact spring 17.

The first fixed terminal 5 includes a first contact support portion 21 and a first external connection portion 24. The first contact support portion 21 supports the first fixed contact 11 in the case 2. The first external connection portion 24 is connected to the first contact support portion 21. The first external connection portion 24 protrudes outward from the case 2. The first external connection portion 24 may be formed integrally with the first contact support portion 21. Alternatively, the first external connection portion 24 may be a separate body from the first contact support portion 21.

The second fixed terminal 6 includes a second contact support portion 31 and a second external connection portion 34. The second contact support portion 31 supports the second fixed contact 12 in the case 2. The second external connection portion 34 is connected to the second contact support portion 31. The second external connection portion 34 protrudes outward from the case 2. The second external connection portion 34 may be formed integrally with the second contact support portion 31. Alternatively, the second external connection portion 34 may be a separate body from the second contact support portion 31.

The drive device 4 generates driving force for operating the movable contact piece 7. The drive device 4 operates the movable contact piece 7 by electromagnetic force. The drive device 4 is disposed below the movable contact piece 7. The drive device 4 includes a coil 41, a spool 42, an iron core 43, a return spring 44, and a yoke 45.

The coil 41 is wound around the spool 42. The coil 41 and the spool 42 are disposed coaxially with the drive shaft 15. The spool 42 includes a hole 42*a* penetrating in an axial direction of the spool 42. The iron core 43 and the return spring 44 are inserted into the hole 42*a* of the spool 42. The yoke 45 is connected to the iron core 43.

The yoke 45 includes a first yoke 45*a* and a second yoke 45*b*. The first yoke 45*a* is disposed between the contact device 3 and the spool 42. The second yoke 45*b* is connected to the first yoke 45*a*. The second yoke 45*b* has a U-shape. The second yoke 45*b* is disposed at each side of the coil 41 and opposite to the first yoke 45*a* with respect to the coil 41.

The iron core 43 includes a fixed iron core 43*a*, a movable iron core 43*b*, and a ring iron core 43*c*. The fixed iron core 43*a* is fixed to the second yoke 45*b*. The ring iron core 43*c* is in contact with the first yoke 45*a*. The movable iron core 43*b* is a separate body from the fixed iron core 43*a* and the ring iron core 43*c*. The movable iron core 43*b* is disposed so as to be movable in the contact direction Z1 and the separation direction Z2. The movable iron core 43*b* moves in the ring iron core 43*c*. The movable iron core 43*b* is connected to the drive shaft 15. The return spring 44 is disposed between the movable iron core 43*b* and the fixed iron core 43*a*. The return spring 44 urges the movable iron core 43*b* in the separation direction Z2.

Figure 2A:
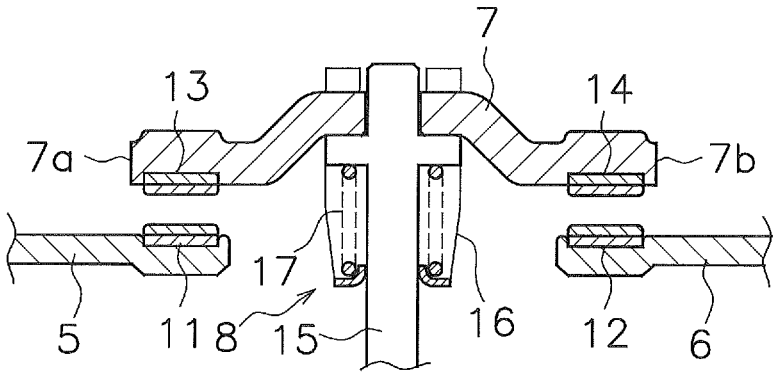
FIG. 2A is a view illustrating an operation of a movable contact piece.
Figure 2B:
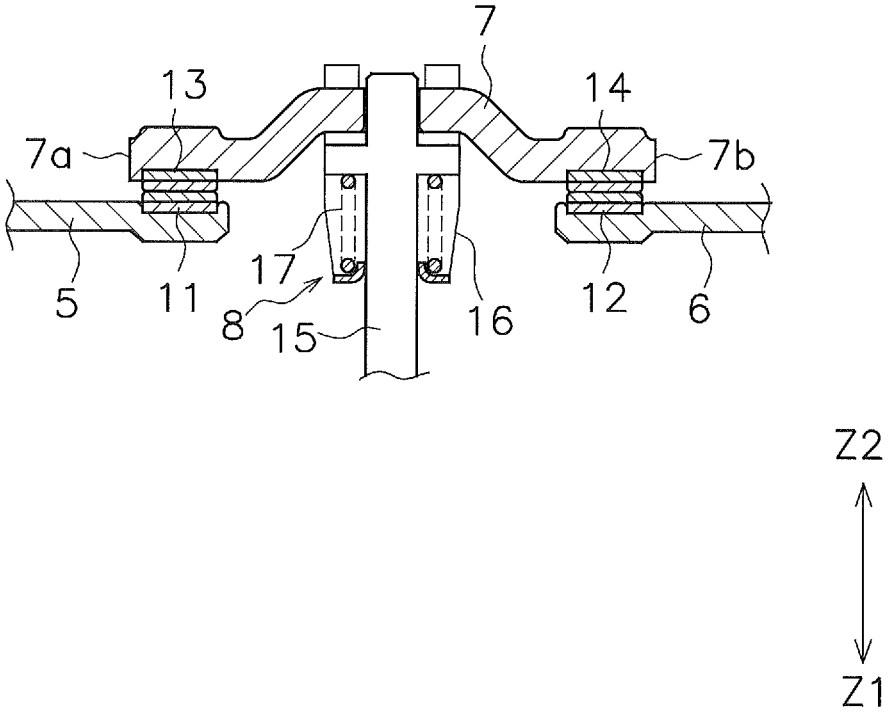
FIG. 2B is a view illustrating an operation of a movable contact piece.

Next, the operation of the relay 1 will be described. FIGS. 2A and 2B are views illustrating the operation of the movable contact piece 7. When a current does not flow through the coil 41 and the coil 41 is not energized, the drive shaft 15 is pressed in the separation direction Z2 by elastic force of the return spring 44 together with the movable iron core 43*b*. Therefore, the movable contact piece 7 is also pressed in the separation direction Z2, and the first movable contact 13 and the second movable contact 14 are in an open state where they are separated from the first fixed contact 11 and the second fixed contact 12 as illustrated in FIG. 2A.

When a current flows through the coil 41 and the coil 41 is energized, the movable iron core 43*b* moves in the contact direction Z1 against the elastic force of the return spring 44 by electromagnetic force of the coil 41. As a result, the drive shaft 15, the holder 16, and the movable contact piece 7 move in the contact direction Z1 together, and the first movable contact 13 and the second movable contact 14 contact the first fixed contact 11 and the second fixed contact 12 as illustrated in FIG. 2B.

When the current through the coil 41 is stopped and the coil 41 is demagnetized, the drive shaft 15 is pressed in the separation direction Z2 by the elastic force of the return spring 44 together with the movable iron core 43*b*. Therefore, the movable contact piece 7 is also pressed in the separation direction Z2, thereby the first movable contact 13 and the second movable contact 14 return to the open state as illustrated in FIG. 2A.

Figure 3:
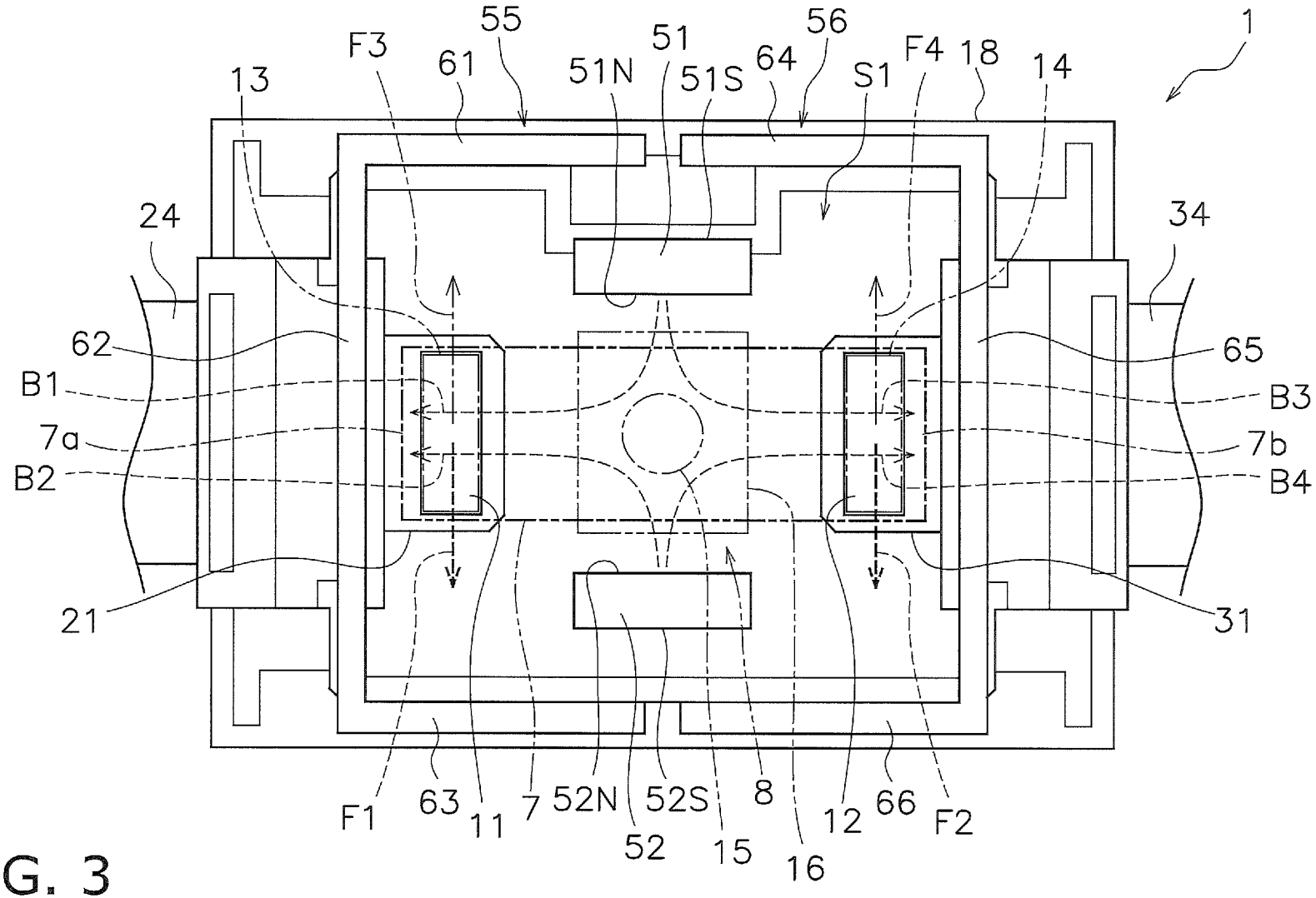
FIG. 3 is a plan view illustrating a configuration in a first housing portion of the relay.
Figure 4:
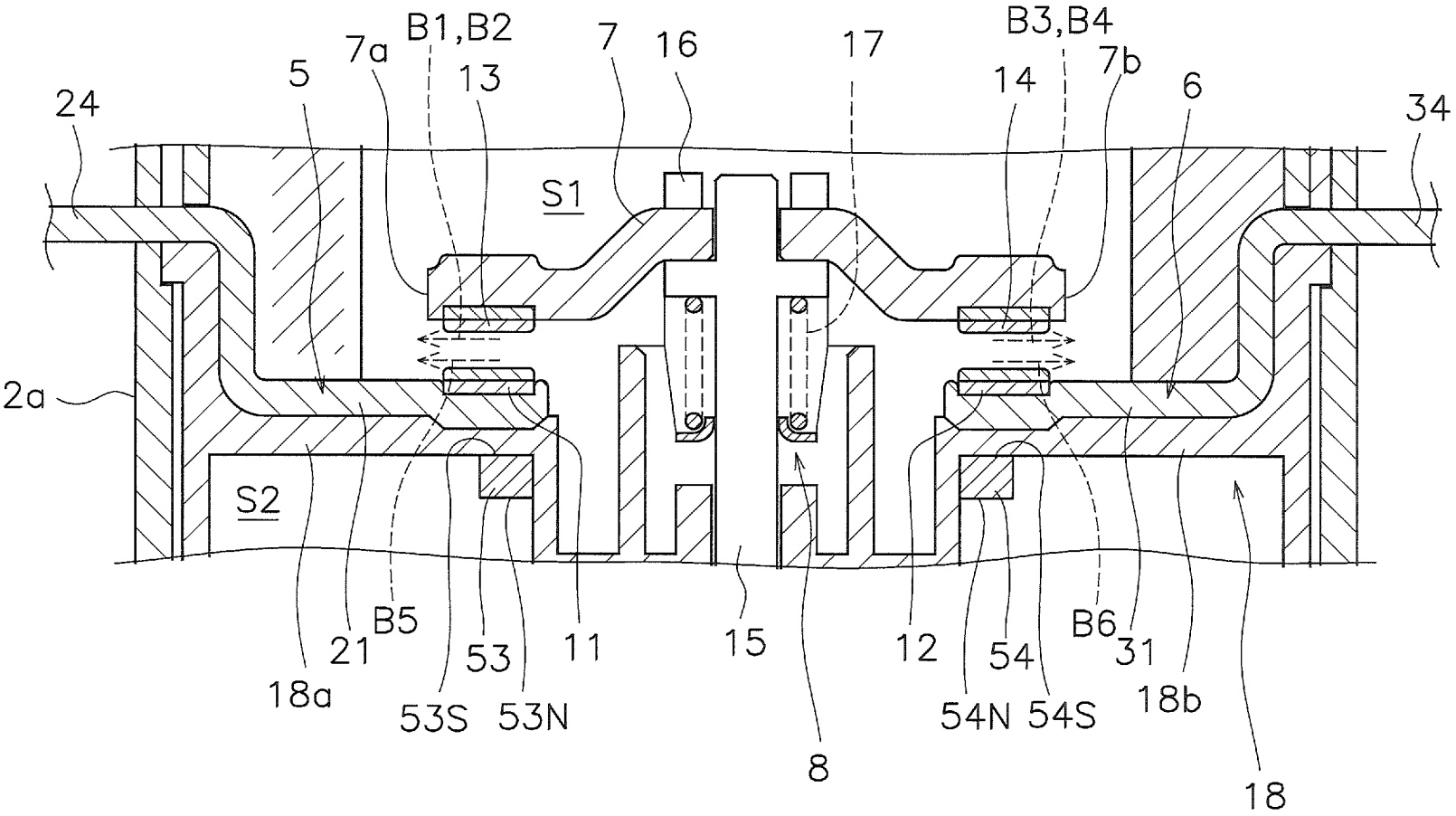
FIG. 4 is an enlarged cross-sectional view illustrating a part of the relay.

FIG. 3 is a plan view illustrating a configuration of the relay 1 in the contact case 18. In FIG. 3, the positions of the movable contact piece 7 and the contact piece holding unit 8 are indicated by chain double-dashed lines. FIG. 4 is an enlarged side cross-sectional view illustrating a part of the relay 1. As illustrated in FIGS. 3 and 4, the relay 1 includes a first magnet 51, a second magnet 52, a third magnet 53, and a fourth magnet 54. The first to fourth magnets 51 to 54 are permanent magnets in order to extinguish an arc generated between the contacts. As illustrated in FIG. 3, the first magnet 51 and the second magnet 52 are disposed apart from each other in the front-back direction. In the present embodiment, the front-back direction coincides with the width direction of the movable contact piece 7 that intersects the longitudinal direction of the movable contact piece 7.

The first magnet 51 is disposed at one side of the movable contact piece 7 in the front-back direction. The second magnet 52 is disposed at the other side of the movable contact piece 7 in the front-back direction. In other words, the movable contact piece 7 is disposed between the first magnet 51 and the second magnet 52 in the front-back direction. The length of the first magnet 51 in the left-right direction is less than a distance between the first movable contact 13 and the second movable contact 14 in the left-right direction. The length of the second magnet 52 in the left-right direction is less than a distance between the first movable contact 13 and the second movable contact 14 in the left-right direction.

The first magnet 51 and the second magnet 52 are disposed so that the same poles thereof face each other. Specifically, the first magnet 51 includes a first surface 51N facing the movable contact piece 7 and a second surface 51S opposite to the first surface 51N. The second magnet 52 includes a first surface 52N facing the movable contact piece 7 and a second surface 52S opposite to the first surface 52N. The first surface 51N of the first magnet 51 and the first surface 52N of the second magnet 52 are both N poles. The second surface 51S of the first magnet 51 and the second surface 52S of the second magnet 52 are both S poles.

The relay 1 includes a first yoke 55 and a second yoke 56. The first yoke 55 and the second yoke 56 surround the movable contact piece 7 in the front-back direction and the left-right direction when viewed from the axial direction of the drive shaft 15, that is, the up-down direction. Accordingly, the strength of the contact case 18 made from resin can be improved.

Specifically, the first yoke 55 includes a first portion 61, a second portion 62, and a third portion 63. The first yoke 55 has a bent shape between the first portion 61 and the second portion 62 and between the second portion 62 and the third portion 63. The first portion 61 and the third portion 63 extend in the left-right direction. The second portion 62 extends in the front-back direction. The first portion 61 faces the second surface 51S of the first magnet 51. The second portion 62 faces the first end portion 7*a* of the movable contact piece 7. The third portion 63 faces the second surface 52S of the second magnet 52.

The second yoke 56 includes a fourth portion 64, a fifth portion 65, and a sixth portion 66. The second yoke 56 has a bent shape between the fourth portion 64 and the fifth portion 65 and between the fifth portion 65 and the sixth portion 66. The fourth portion 64 and the sixth portion 66 extend in the left-right direction. The fifth portion 65 extends in the front-back direction. The fourth portion 64 faces the second surface 51S of the first magnet 51. The fifth portion 65 faces the second end portion 7*b* of the movable contact piece 7. The sixth portion 66 faces the second surface 52S of the second magnet 52.

With the abovementioned disposition of the magnets 51 and 52, magnetic fluxes B1 and B2 in the left-right direction between the first fixed contact 11 and the first movable contact 13 are generated by the first magnet 51 and the second magnet 52 as illustrated in FIG. 3. Further, magnetic fluxes B3 and B4 in the left-right direction between the second fixed contact 12 and the second movable contact 14 are generated by the first magnet 51 and the second magnet 52. Specifically, the magnetic fluxes B1 and B2 toward the first end portion 7*a* from the center in the left-right direction are generated between the first fixed contact 11 and the first movable contact 13. The magnetic fluxes B3 and B4 toward the second end portion 7*b* from the center in the left-right direction are generated between the second fixed contact 12 and the second movable contact 14.

As illustrated in FIG. 4, the third magnet 53 is disposed apart from the first fixed contact 11 and the first movable contact 13 in the up-down direction. The fourth magnet 54 is disposed apart from the second fixed contact 12 and the second movable contact 14 in the up-down direction. Specifically, the third magnet 53 is disposed downwardly apart from the first fixed contact 11 and the first movable contact 13. The fourth magnet 54 is disposed downwardly apart from the second fixed contact 12 and the second movable contact 14. In other words, the first fixed contact 11 is disposed between the first movable contact 13 and the third magnet 53 in the up-down direction. The second fixed contact 12 is disposed between the second movable contact 14 and the fourth magnet 54 in the up-down direction.

Figure 5:
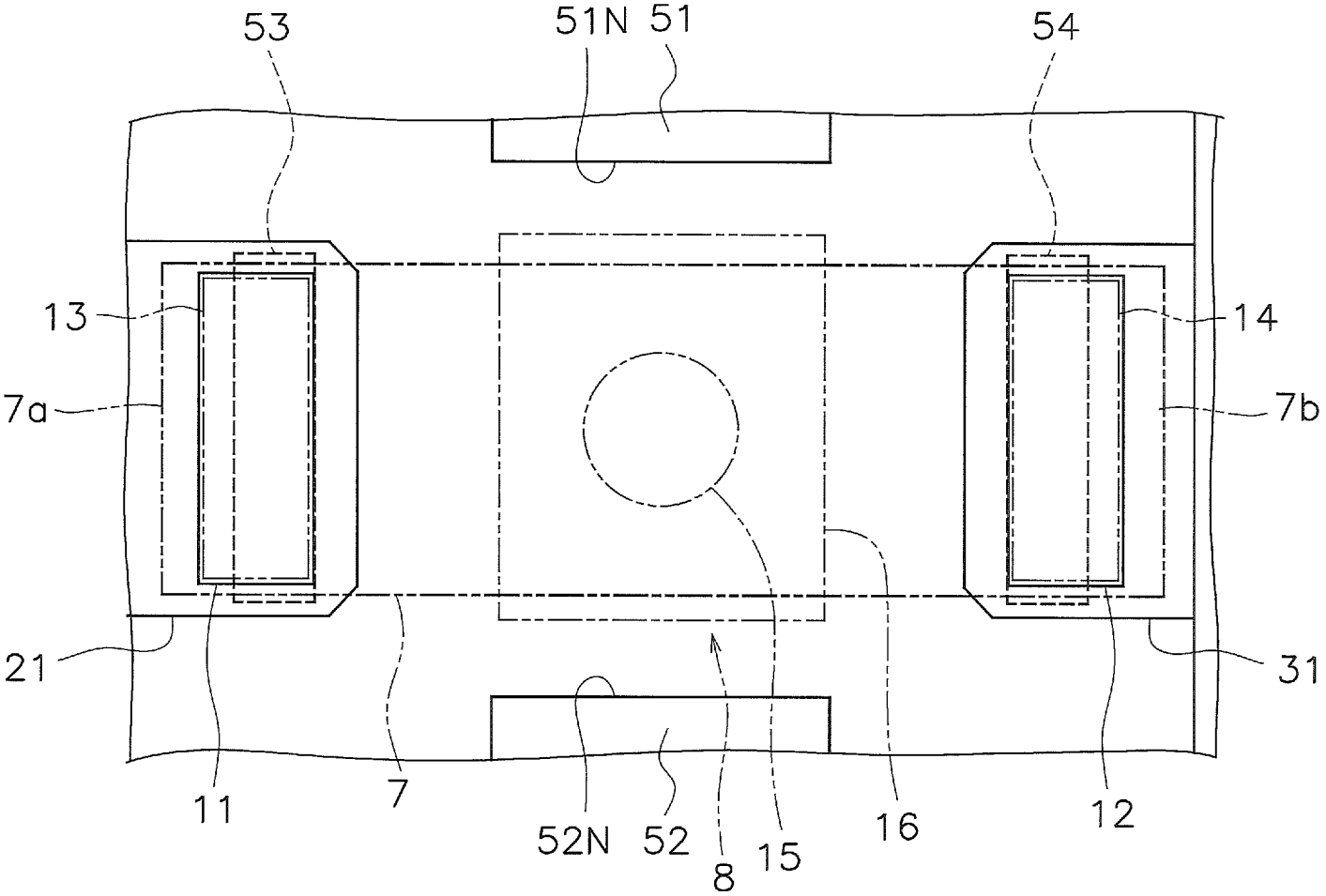
FIG. 5 is an enlarged view illustrating a part of FIG. 3.

FIG. 5 is an enlarged view of FIG. 3. As illustrated in FIG. 5, at least a part of the third magnet 53 overlaps with the first fixed contact 11 and the first movable contact 13 when viewed in the up-down direction. At least a part of the fourth magnet 54 overlaps with the second fixed contact 12 and the second movable contact 14 when viewed in the up-down direction.

As illustrated in FIG. 4, the third magnet 53 and the fourth magnet 54 are disposed in the second housing portion S2. The contact case 18 includes a first partition wall 18*a* and a second partition wall 18*b*. The first partition wall 18*a* is disposed between the first fixed contact 11 and the third magnet 53. The first fixed contact 11 is disposed between the first movable contact 13 and the first partition wall 18*a*. The first partition wall 18*a* supports the first contact support portion 21. The second partition wall 18*b* is disposed between the second fixed contact 12 and the fourth magnet 54. The second fixed contact 12 is disposed between the second movable contact 14 and the second partition wall 18*b*. The second partition wall 18*b* supports the second contact support portion 31.

The third magnet 53 is disposed so as to generate, at a position between the first fixed contact 11 and the first movable contact 13, a magnetic flux B5 in a same direction as the magnetic fluxes B1 and B2 by the first magnet 51 and the second magnet 52. That is, the third magnet 53 is disposed so as to generate the magnetic flux B5 in the left-right direction at a position between the first fixed contact 11 and the first movable contact 13. Therefore, the third magnet 53 increases the magnetic flux in the left-right direction at a position between the first fixed contact 11 and the first movable contact 13 by combining with the magnetic fluxes B1 and B2 by the first magnet 51 and the second magnet 52.

The fourth magnet 54 is disposed so as to generate, at a position between the second fixed contact 12 and the second movable contact 14, a magnetic flux B6 in a same direction as the magnetic fluxes B3 and B4 by the first magnet 51 and the second magnet 52. That is, the fourth magnet 54 is disposed so as to generate the magnetic flux B6 in the left-right direction at a position between the second fixed contact 12 and the second movable contact 14. Therefore, the fourth magnet 54 increases the magnetic flux in the left-right direction at a position between the second fixed contact 12 and the second movable contact 14 by combining with the magnetic fluxes B3 and B4 by the first magnet 51 and the second magnet 52.

Specifically, the third magnet 53 includes a first surface 53S and a second surface 53N. The first surface 53S and the second surface 53N are end surfaces of the third magnet 53 in the up-down direction. The first surface 53S is disposed facing the first fixed contact 11. The second surface 53N is disposed opposite to the first fixed contact 11. The fourth magnet 54 includes a first surface 54S and a second surface 54N. The first surface 54S and the second surface 54N are end surfaces of the fourth magnet 54 in the up-down direction. The first surface 54S is disposed facing the second fixed contact 12. The second surface 54N is disposed opposite to the second fixed contact 12. The first surface 53S of the third magnet 53 and the first surface 54S of the fourth magnet 54 both have a south pole. The second surface 53N of the third magnet 53 and the second surface 54N of the fourth magnet 54 are both N poles.

With the abovementioned disposition of the third magnet 53 and the fourth magnet 54, the magnetic flux B5 in the left-right direction between the first fixed contact 11 and the first movable contact 13 is generated by the third magnet 53 as illustrated in FIG. 4. The magnetic flux B6 in the left-right direction between the second fixed contact 12 and the second movable contact 14 is generated by the fourth magnet 54. Specifically, the magnetic flux B5 toward the first end portion 7*a* from the center of the movable contact piece 7 in the left-right direction is generated between the first fixed contact 11 and the first movable contact 13 by the third magnet 53. The magnetic flux B6 toward the second end portion 7*b* from the center of the movable contact piece 7 in the left-right direction is generated between the second fixed contact 12 and the second movable contact 14 by the fourth magnet 54.

In the relay 1 according to the present embodiment described above, the first magnet 51 and the second magnet 52 are disposed so that the same poles thereof face each other, and the movable contact piece 7 is disposed between the first magnet 51 and the second magnet 52 in the front-back direction. Therefore, the magnetic fluxes B1 and B2 are generated along the left-right direction between the first fixed contact 11 and the first movable contact 13. Further, the magnetic fluxes B3 and B4 are generated along the left-right direction between the second fixed contact 12 and the second movable contact 14. Accordingly, when a current flows from left to right in the movable contact piece 7, Lorentz force acts in the front-back direction as indicated by arrows F1 and F2 in FIG. 3. Further, when a current flows from right to left in the movable contact piece 7, Lorentz force acts in the front-back direction as indicated by arrows F3 and F4 in FIG. 3. As a result, it is possible to reduce the influence on the arc extinguishing properties by the current flow direction.

The movable contact piece 7 is disposed between the first magnet 51 and the second magnet 52 in the front-back direction. Therefore, even if wear debris generated from the contact piece holding unit 8 is attracted to the first magnet 51 or the second magnet 52, the wear debris moves in a direction different from where the contacts 11 to 14 are located. As a result, it is possible to prevent the wear debris from being caught between the contacts 11 to 14 and to reduce the deterioration in the energization performance due to the wear debris.

The third magnet 53 is disposed so as to increase the magnetic flux in the left-right direction at a position between the first fixed contact 11 and the first movable contact 13. The fourth magnet 54 is disposed so as to increase the magnetic flux in the left-right direction at a position between the second fixed contact 12 and the second movable contact 14. Accordingly, the arc extinguishing properties can be improved. Further, even if the wear debris generated from the contact piece holding unit 8 is attracted to the third magnet 53 or the fourth magnet 54, the wear debris moves in a direction different from where the contacts 11 to 14 are located. As a result, it is possible to prevent the wear debris from being caught between the contacts 11 to 14 and to reduce the deterioration in the energization performance due to the wear debris.

The third magnet 53 and the fourth magnet 54 are disposed in the second housing portion S2. The first partition wall 18*a* is disposed between the first fixed contact 11 and the third magnet 53. Further, the second partition wall 18*b* is disposed between the second fixed contact 12 and the fourth magnet 54. Therefore, it is possible to prevent the wear debris from adhering to the third magnet 53 and the fourth magnet 54.

The first fixed contact 11 is disposed between the first movable contact 13 and the third magnet 53 in the up-down direction. Since the first fixed contact 11 does not move, the third magnet 53 can be disposed proximate to the first fixed contact 11. Further, the second fixed contact 12 is disposed between the second movable contact 14 and the fourth magnet 54 in the up-down direction. Since the second fixed contact 12 does not move, the fourth magnet 54 can be disposed proximate to the second fixed contact 12.

The length of the first magnet 51 in the left-right direction is less than a distance between the first movable contact 13 and the second movable contact 14 in the left-right direction. Therefore, the first magnet 51 can be disposed such that its ends in the left-right direction are spaced apart from the first movable contact 13 and the second movable contact 14. Accordingly, even if the wear debris generated from the contact piece holding unit 8 is attracted to the first magnet 51, it is possible to prevent the wear debris from approaching the first movable contact 13 or the second movable contact 14. As a result, it is possible to reduce the deterioration in the energization performance due to wear debris.

The length of the second magnet 52 in the left-right direction is less than a distance between the first movable contact 13 and the second movable contact 14 in the left-right direction. Therefore, the second magnet 52 can be disposed such that its ends in the left-right direction are spaced apart from the first movable contact 13 and the second movable contact 14. Accordingly, even if the wear debris generated from the contact piece holding unit 8 is attracted to the second magnet 52, it is possible to prevent the wear debris from approaching the first movable contact 13 or the second movable contact 14. As a result, it is possible to reduce the deterioration in the energization performance due to wear debris.

Although an embodiment of the present invention has been described so far, the present invention is not limited to the above embodiment and various modifications may be made within the scope of the invention. For example, the configuration of the drive device 4 may be changed. The shapes or disposition of the coil 41, the spool 42, the iron core 43, the return spring 44, and the yoke 45 may be changed. The shape or disposition of the case 2 may be changed.

In the above embodiment, the drive device 4 pulls the drive shaft 15 toward the coil 41, thereby the movable contact piece 7 moves in the contact direction Z1. Further, the drive device 4 pushes the drive shaft 15 from the coil 41 side, thereby the movable contact piece 7 moves in the separation direction Z2. However, the movable contact piece 7 may move in the separation direction Z2 by pulling the drive shaft 15 toward the coil 41 due to the drive device 4. The movable contact piece 7 may move in the contact direction Z1 by pushing the drive shaft 15 from the coil 41 side due to the drive device 4. That is, the contact direction Z1 and the separation direction Z2 may be upside down from those in the above embodiment.

The shapes or disposition of the first fixed terminal 5, the second fixed terminal 6, and the movable contact piece 7 may be changed. For example, the first fixed terminal 5 may have a bent shape from the first contact support portion 21 toward the coil 41. The second fixed terminal 6 may have a bent shape from the second contact support portion 31 toward the coil 41.

The first fixed contact 11 may be a body separate from or integral with the first fixed terminal 5. The second fixed contact 12 may be a body separate from or integral with the second fixed terminal 6. The first movable contact 13 may be a body separate from or integral with the movable contact piece 7. The second movable contact 14 may be a body separate from or integral with the movable contact piece 7.

Figure 6:
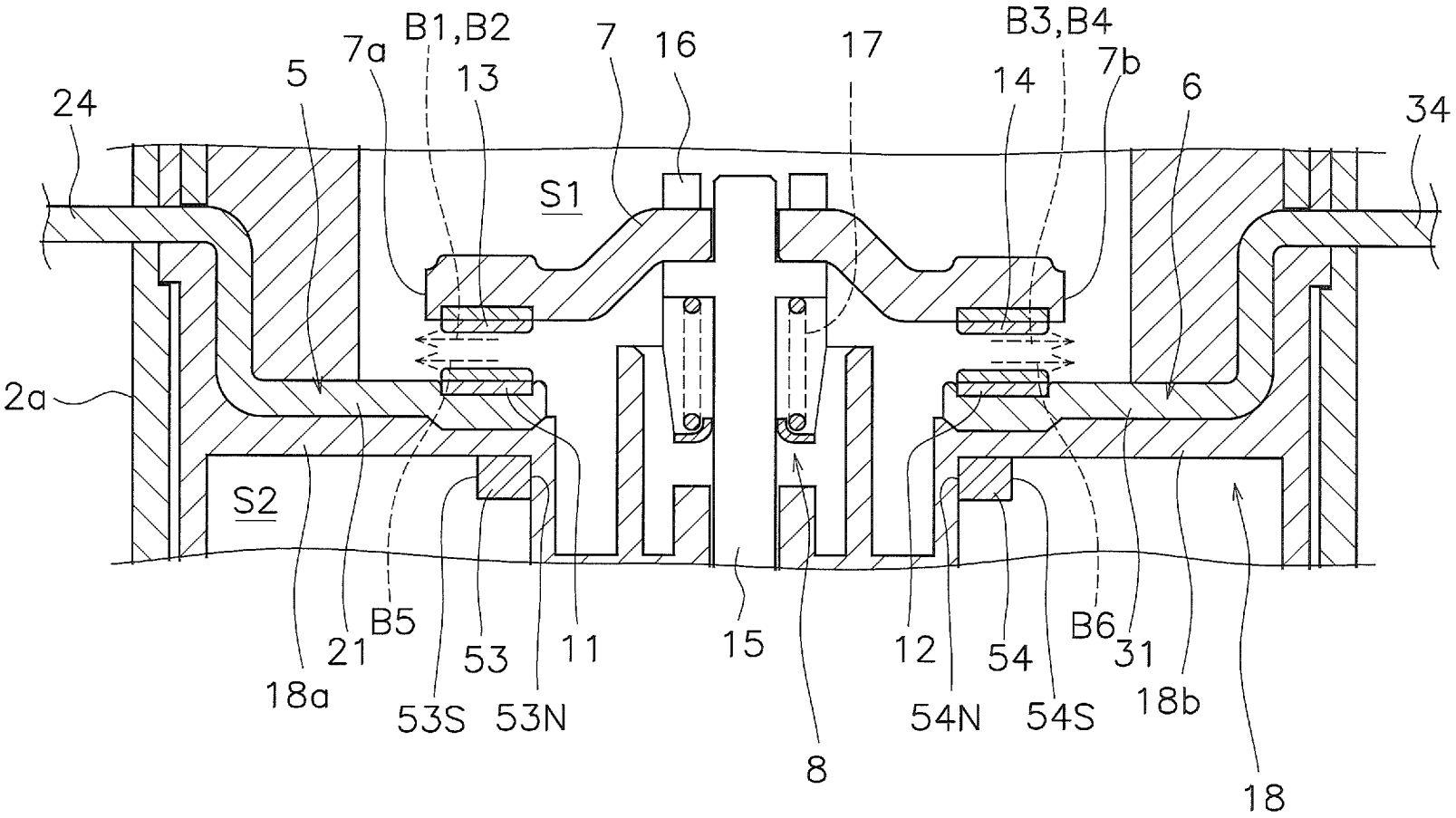
FIG. 6 is a view illustrating a disposition of a third magnet and a fourth magnet according to a first modified example.

The disposition of the poles of the first to fourth magnets 51 to 54 is not limited to that of the above embodiment, and may be changed. For example, FIG. 6 is a view illustrating the disposition of the third magnet 53 and the fourth magnet 54 according to a first modified example. As illustrated in FIG. 6, the third magnet 53 includes the first surface 53S and the second surface 53N. The first surface 53S and the second surface 53N are end surfaces of the third magnet 53 in the left-right direction. The first surface 53S is the left end surface of the third magnet 53. The second surface 53N is the right end surface of the third magnet 53. The fourth magnet 54 includes the first surface 54S and the second surface 54N. The first surface 54S and the second surface 54N are end surfaces of the fourth magnet 54 in the left-right direction. The first surface 54S is the right end surface of the fourth magnet 54. The second surface 54N is the left end surface of the fourth magnet 54. The first surface 53S of the third magnet 53 and the first surface 54S of the fourth magnet 54 both have a south pole. The second surface 53N of the third magnet 53 and the second surface 54N of the fourth magnet 54 are both N poles.

In the disposition of the third magnet 53 and the fourth magnet 54 according to the first modified example, a magnetic flux toward the first end portion 7*a* from the center of the movable contact piece 7 in the left-right direction is generated between the first fixed contact 11 and the first movable contact 13 by the third magnet 53 in the same manner as the above embodiment. Further, a magnetic flux toward the second end portion 7*b* from the center of the movable contact piece 7 in the left-right direction is generated between the second fixed contact 12 and the second movable contact 14 by the fourth magnet 54.

Figure 7:
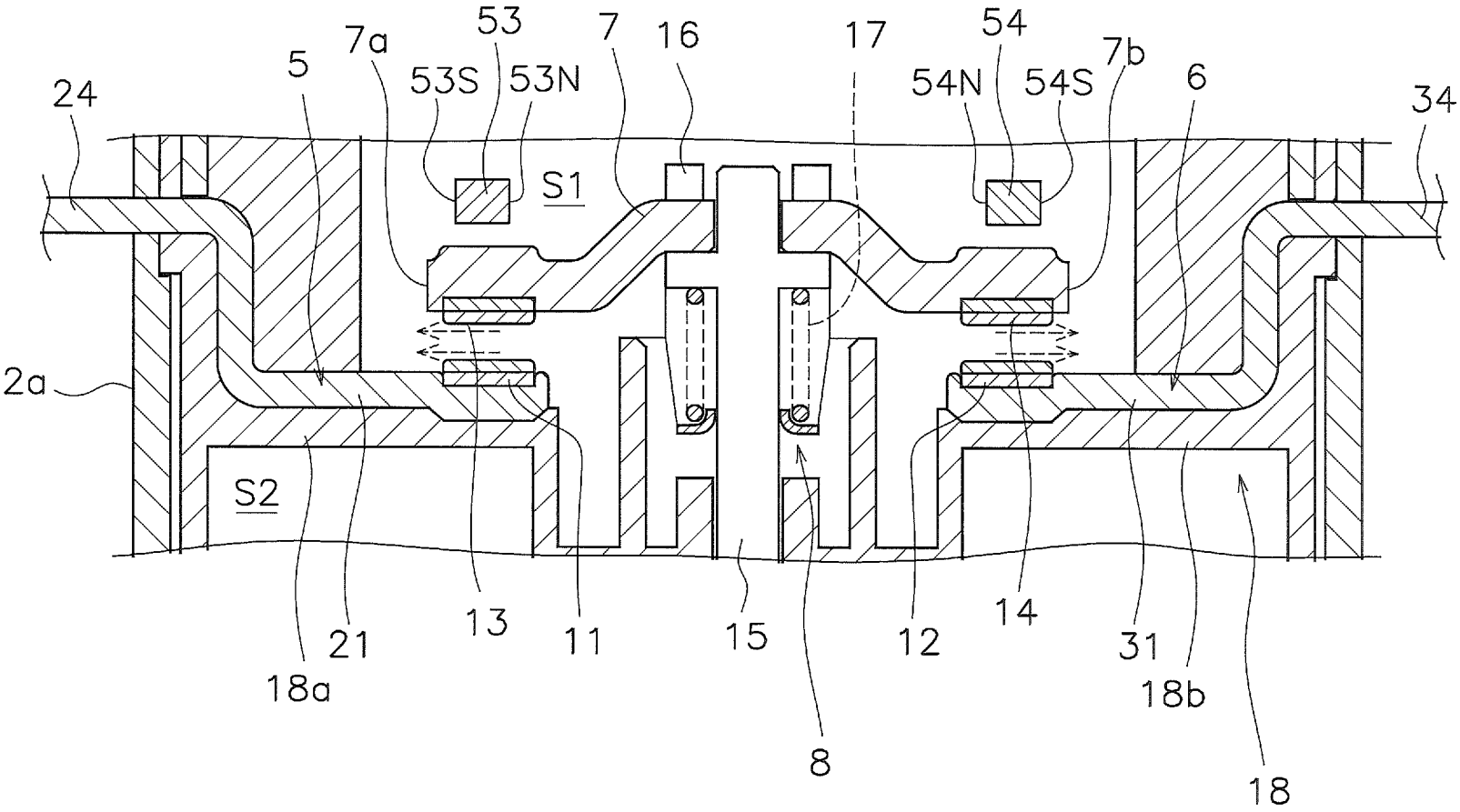
FIG. 7 is a view illustrating a disposition of the third magnet and the fourth magnet according to a second modified example.
Figure 8A:
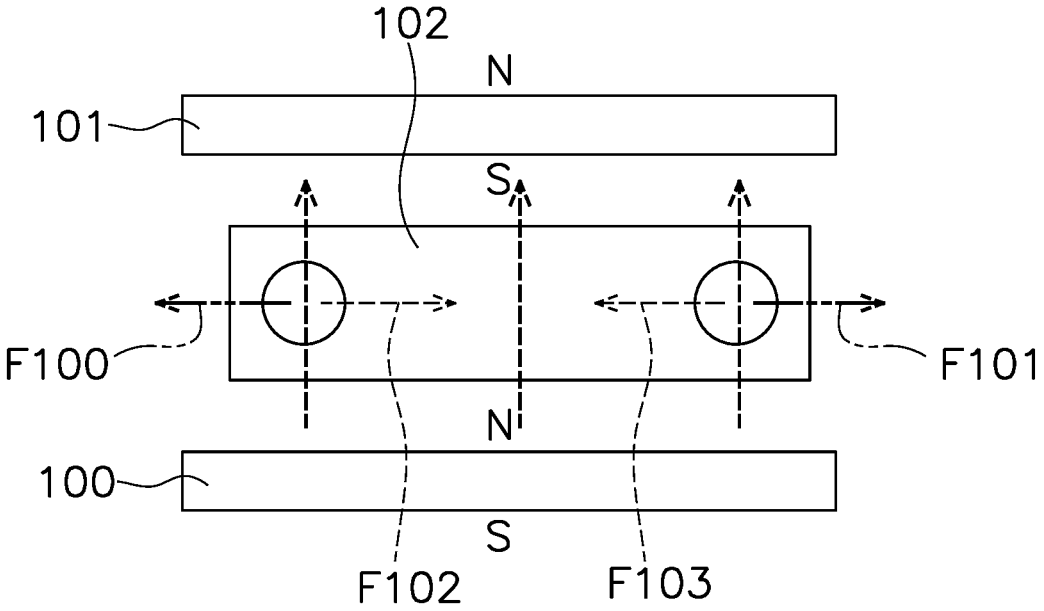
FIG. 8A (RELATED ART)
FIG. 8A is a schematic view illustrating a disposition of contacts and magnets according to a related art.
Figure 8B:
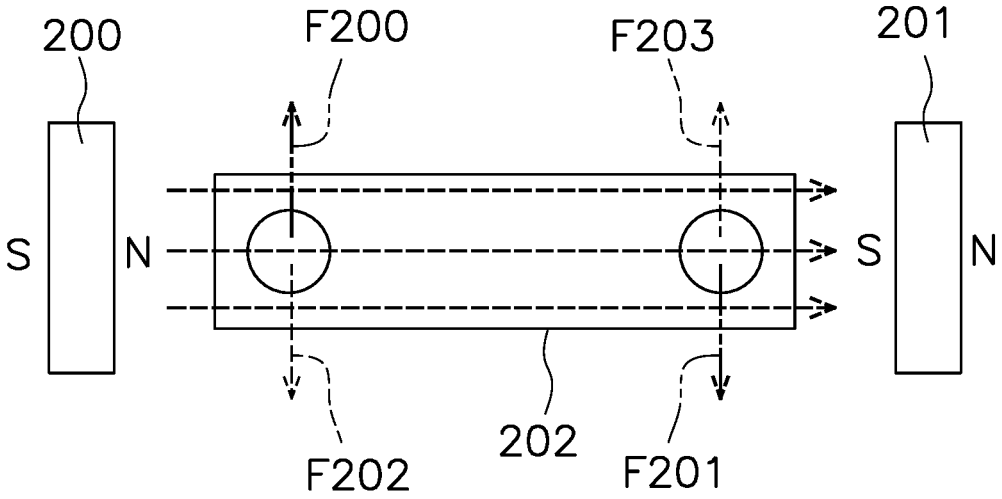
FIG. 8B (RELATED ART)
FIG. 8B is a schematic view illustrating a disposition of contacts and magnets according to a related art.

The disposition of the first to fourth magnets 51 to 54 is not limited to that of the above embodiment, and may be changed. For example, the third magnet 53 and the fourth magnet 54 may be disposed in the first housing portion S1. FIG. 7 is a view illustrating the disposition of the third magnet 53 and the fourth magnet 54 according to a second modified example. As illustrated in FIG. 7, the third magnet 53 and the fourth magnet 54 may be disposed above the movable contact piece 7. In other words, the movable contact piece 7 may be disposed between the first fixed contact 11 and the third magnet 53 in the up-down direction. The movable contact piece 7 may be disposed between the second fixed contact 12 and the fourth magnet 54 in the up-down direction.

Alternatively, one of the third magnet 53 or the fourth magnet 54 is disposed above the movable contact piece 7, and the other of the third magnet 53 or the fourth magnet 54 is disposed below the first fixed contact 11 or the second fixed contact 12.

REFERENCE NUMERALS

2 Case
7 Movable contact piece
11 First fixed contact
12 Second fixed contact
13 First movable contact
14 Second movable contact
18*a* First partition wall
18*b* Second partition wall
51 First magnet
52 Second magnet
53 Third magnet
54 Forth magnet
S1 First housing portion
S2 Second housing portion

The invention claimed is:

1. A relay comprising:

a first fixed contact;

a second fixed contact;

a movable contact piece, including a first movable contact and a second movable contact arranged apart from each other in a longitudinal direction of the movable contact piece, the movable contact piece being movably disposed in a moving direction including a first direction in which the first movable contact comes into contact with the first fixed contact and the second movable contact comes into contact with the second fixed contact and a second direction in which the first movable contact is separated from the first fixed contact and the second movable contact is separated from the second fixed contact;

a contact piece holding unit configured to hold the movable contact piece at a position between the first movable contact and the second movable contact in the longitudinal direction of the movable contact piece;

a case including a first housing portion and a second housing portion partitioned from the first housing portion, the first housing portion configured to house the first fixed contact, the second fixed contact, and the movable contact piece;

a first magnet disposed at a first side of the movable contact piece in a width direction of the movable contact piece that intersects the longitudinal direction of the movable contact piece;

a second magnet disposed at a second side of the movable contact piece in the width direction of the movable contact piece;

a third magnet disposed apart from the first fixed contact and the first movable contact in the moving direction of the movable contact piece; and a fourth magnet disposed apart from the second fixed contact and the second movable contact in the moving direction of the movable contact piece, wherein the first magnet and the second magnet are disposed so that same poles thereof face each other, the movable contact piece is disposed between the first magnet and the second magnet in the width direction of the movable contact piece, at least one of the third magnet or the fourth magnet is disposed in the second housing portion, the third magnet is configured to increase a magnetic flux flowing between the first fixed contact and the first movable contact in the longitudinal direction of the movable contact piece, and the fourth magnet is configured to increase a magnetic flux flowing between the second fixed contact and the second movable contact in the longitudinal direction of the movable contact piece.

2. The relay according to claim 1, wherein the first fixed contact is disposed between the first movable contact and the third magnet in the moving direction of the movable contact piece.

3. The relay according to claim 1, wherein the second fixed contact is disposed between the second movable contact and the fourth magnet in the moving direction of the movable contact piece.

4. The relay according to claim 1, wherein at least a part of the third magnet overlaps with the first fixed contact or the first movable contact when viewed from the moving direction of the movable contact piece.

5. The relay according to claim 1, wherein at least a part of the fourth magnet overlaps with the second fixed contact or the second movable contact when viewed from the moving direction of the movable contact piece.

6. The relay according to claim 1, wherein a length of the first magnet in the longitudinal direction of the movable contact piece is less than a distance between the first movable contact and the second movable contact in the longitudinal direction of the movable contact piece.

7. The relay according to claim 1, further comprising:

a length of the second magnet in the longitudinal direction of the movable contact piece is less than a distance between the first movable contact and the second movable contact in the longitudinal direction of the movable contact piece.

8. The relay according to claim 1, further comprising:

a first partition wall disposed between the first fixed contact and the third magnet.

9. The relay according to claim 1, further comprising:

a second partition wall disposed between the second fixed contact and the fourth magnet.

10. The relay according to claim 1, further comprising:

a first partition wall disposed between the first fixed contact and the third magnet; and a second partition wall disposed between the second fixed contact and the fourth magnet.

11. A relay comprising:

a first fixed contact;

a second fixed contact;

a movable contact piece, including a first movable contact and a second movable contact arranged apart from each other in a longitudinal direction of the movable contact piece, the movable contact piece being movably disposed in a moving direction including a first direction in which the first movable contact comes into contact with the first fixed contact and the second movable contact comes into contact with the second fixed contact and a second direction in which the first movable contact is separated from the first fixed contact and the second movable contact is separated from the second fixed contact;

a contact piece holding unit configured to hold the movable contact piece at a position between the first movable contact and the second movable contact in the longitudinal direction of the movable contact piece;

a first magnet disposed at a first side of the movable contact piece in a width direction of the movable contact piece that intersects the longitudinal direction of the movable contact piece;

a second magnet disposed at a second side of the movable contact piece in the width direction of the movable contact piece;

a third magnet disposed apart from the first fixed contact and the first movable contact in the moving direction of the movable contact piece;

a fourth magnet disposed apart from the second fixed contact and the second movable contact in the moving direction of the movable contact piece; and a first partition wall disposed between the first fixed contact and the third magnet, wherein the first magnet and the second magnet are disposed so that same poles thereof face each other, the movable contact piece is disposed between the first magnet and the second magnet in the width direction of the movable contact piece, the third magnet is configured to increase a magnetic flux flowing between the first fixed contact and the first movable contact in the longitudinal direction of the movable contact piece, and the fourth magnet is configured to increase a magnetic flux flowing between the second fixed contact and the second movable contact in the longitudinal direction of the movable contact piece.

12. The relay according to claim 11, further comprising:

a second partition wall disposed between the second fixed contact and the fourth magnet.

13. The relay according to claim 11, wherein the first fixed contact is disposed between the first movable contact and the third magnet in the moving direction of the movable contact piece.

14. The relay according to claim 11, wherein the second fixed contact is disposed between the second movable contact and the fourth magnet in the moving direction of the movable contact piece.

15. The relay according to claim 11, wherein at least a part of the third magnet overlaps with the first fixed contact or the first movable contact when viewed from the moving direction of the movable contact piece.

16. The relay according to claim 11, wherein at least a part of the fourth magnet overlaps with the second fixed contact or the second movable contact when viewed from the moving direction of the movable contact piece.

17. The relay according to claim 11, wherein a length of the first magnet in the longitudinal direction of the movable contact piece is less than a distance between the first movable contact and the second movable contact in the longitudinal direction of the movable contact piece.

18. The relay according to claim 11, further comprising:

a length of the second magnet in the longitudinal direction of the movable contact piece is less than a distance between the first movable contact and the second movable contact in the longitudinal direction of the movable contact piece.

19. A relay comprising:

a first fixed contact;

a second fixed contact;

a movable contact piece, including a first movable contact and a second movable contact arranged apart from each other in a longitudinal direction of the movable contact piece, the movable contact piece being movably disposed in a moving direction including a first direction in which the first movable contact comes into contact with the first fixed contact and the second movable contact comes into contact with the second fixed contact and a second direction in which the first movable contact is separated from the first fixed contact and the second movable contact is separated from the second fixed contact;

a contact piece holding unit configured to hold the movable contact piece at a position between the first movable contact and the second movable contact in the longitudinal direction of the movable contact piece;

a first magnet disposed at a first side of the movable contact piece in a width direction of the movable contact piece that intersects the longitudinal direction of the movable contact piece;

a second magnet disposed at a second side of the movable contact piece in the width direction of the movable contact piece;

a third magnet disposed apart from the first fixed contact and the first movable contact in the moving direction of the movable contact piece;

a fourth magnet disposed apart from the second fixed contact and the second movable contact in the moving direction of the movable contact piece; and a second partition wall disposed between the second fixed contact and the fourth magnet;

wherein the first magnet and the second magnet are disposed so that same poles thereof face each other, the movable contact piece is disposed between the first magnet and the second magnet in the width direction of the movable contact piece, the third magnet is configured to increase a magnetic flux flowing between the first fixed contact and the first movable contact in the longitudinal direction of the movable contact piece, and the fourth magnet is configured to increase a magnetic flux flowing between the second fixed contact and the second movable contact in the longitudinal direction of the movable contact piece.

* * * * *